United States Patent [19]

Germann

[11] Patent Number: 4,717,141

[45] Date of Patent: Jan. 5, 1988

[54] SHEET BRAKE AND DELIVERY ASSEMBLY

[75] Inventor: Albrecht J. Germann, Würzburg, Fed. Rep. of Germany

[73] Assignee: Koenig & Bauer Aktiengesellschaft, Fed. Rep. of Germany

[21] Appl. No.: 937,271

[22] Filed: Dec. 3, 1986

[30] Foreign Application Priority Data

Dec. 5, 1985 [DE] Fed. Rep. of Germany ..... 3543026

[51] Int. Cl.[4] ..... B65H 29/68

[52] U.S. Cl. ..... 271/183

[58] Field of Search ..... 271/182, 183, 202, 203

[56] References Cited

U.S. PATENT DOCUMENTS 3,730,517 5/1973 Norton ..... 271/183

4,625,956 12/1986 Marass ..... 271/183

FOREIGN PATENT DOCUMENTS 721545 4/1942 Fed. Rep. of Germany .

*Primary Examiner*—Richard A. Schacher

*Attorney, Agent, or Firm*—Jones, Tullar & Cooper

[57] ABSTRACT

A rotatable sheet brake roller, whose peripheral speed is varied in response to the speed of a printed sheet transport means, is disclosed. Initially, the sheet brake roller runs at a peripheral speed generally the same as the sheet transport speed. Once the sheet is released from its transport, the sheet brake roller decelerates to slow the sheet to a sheet delivery speed. A dampening unit is associated with the sheet brake roller which has a surface that repels printing ink. The dampening unit removes ink particles from the surface of the sheet brake roller to eliminate smearing which would otherwise occur, particularly in recto and verso printing when a freshly printed surface of the printed sheet contacts the surface of the sheet brake roller.

6 Claims, 6 Drawing Figures

SHEET BRAKE AND DELIVERY ASSEMBLY

FIELD OF THE INVENTION

The present invention is directed generally to a sheet brake and delivery assembly for a sheet-fed rotary printing press. More particularly, the present invention is directed to a sheet brake which utilizes a controllable speed sheet brake roller. Most specifically, the present invention is directed to a speed controlled sheet brake roller having a cooperating dampening unit. The sheet brake roller and delivery assembly is utilized to receive printed sheets from the sheet-fed rotary printing press and to reduce the forward speed of the sheets as they are placed on a sheet stacking table. The sheets may have been printed in recto and verso and thus have fresh ink on an under surface of each sheet. It is accordingly important that the sheet brake roller not smear or smudge this fresh ink. This is accomplished by using an ink repellent material for the peripheral surface of the sheet brake roller and by using a cooperating dampening unit. The speed of the sheet brake roller is controllable so that the roller initially turns at a speed generally equal to the speed of the sheet being delivered, then slows to a sheet depositing speed, and later re-accelerates back to a sheet delivery speed.

DESCRIPTION OF THE PRIOR ART

The use of various types of sheet brakes in printing machines is generally knows in the art. For example, a prior sheet brake is shown in German Patent No. 721,545. This disclosure shows a plurality of rotatable suction bodies which have a peripheral speed that is the same as the speed of the sheet transporting gripper chain at the point where the rotatable suction bodies take the sheets over from the sheet transport gripper chain. Once each sheet have been released by the gripper chain and has been taken over by the plurality of rotating suction bodies, their speed of rotation is continually reduced until such time as the trailing end of the sheet is released by the suction bodies. This effects braking or deceleration of the sheet.

In the use of sheet brakes of the speed controlled roller type, as discussed generally above, and particularly when such sheet brakes are used with printing machines capable of recto and verso printing, there is a substantial likelihood of the freshly printed ink on the undersurface of the sheets being smeared or blurred through contact with the rotating suction bodies. At the moment when each sheet is being taken over by the suction bodies, their relative speeds may be different. This difference in speed leads to possible initial slippage or motion between the newly printed sheet and the surface of the rotatable suction bodies. This motion may result in reduced printing quality because of ink smears and smudges. As the sheet fed rotary printing machine's speed of production increases, the likelihood of ink smearing also increases.

It is frequently necessary to provide controllable speed sheet braking means in printing presses, as can be seen from the above discussion. Unfortunately this has resulted in a danger of sheet smearing. The prior art devices have not eliminated the problem of fresh ink smearing, especially in recto and verso printing, and thus a need exists for a controllable speed sheet brake assembly which will reduce the forward speed of printed sheets while not adversely affecting printing quality. The sheet brake and delivery assembly in accordance with the present invention provides such a device and does so in an effective, efficient manner.

SUMMARY OF THE INVENTION

It is an object of the present invention to provide a controllable speed sheet brake.

Another object of the present invention is to provide a controllable speed sheet brake which utilizes a variable speed suction roller.

A further object of the present invention is to provide a controllable speed sheet brake roller useable with freshly printed sheets.

Yet another object of the present invention is to provide a controllable speed sheet brake roller which can be used with a recto and verso sheet-fed rotary printing machine.

Still a further object of the present invention is to provide a controllable speed sheet brake having a roller with a hydrophillic surface.

Even yet another object of the present invention is to provide a speed controllable sheet brake roller having a cooperatively positioned dampening unit.

As will be discussed in greater detail in the description of the preferred embodiment which is set forth subsequently, the controllable sheet brake and delivery assembly in accordance with the present invention includes a rotatable sheet brake roller which is positioned generally beneath a sheet guide plate and which has an initial peripheral speed of rotation generally the same as the linear speed of the sheet transporting gripper chains. Once the spaced sheet grippers that carry the sheets on the gripper chains have released the sheets, the controllable speed sheet brake roller is caused to reduce its speed so that the high sheet transport speed is reduced to a slower sheet delivery speed. The sheet brake roller is preferably provided with suitable suction means to grasp the surface of the sheet. In order to avoid smearing the freshly printed ink, especially when the sheet-fed rotary printing machine is operating as a recto and verso printing machine, the surface of the controllable speed braking roller is made of a hydrophillic material. Additionally, suitable dampening means are further provided to maintain the controllable speed ink brake roller's surface free of ink particles. In this way smearing and smudging of the freshly printed ink is avoided.

A primary advantage of the controllable speed sheet brake and delivery assembly of the present invention is that it provides sure and smear-free sheet deposition. This is true even at the high rates of speed at which the present sheet-fed rotary printing machines operate. This is also true even when the printed sheets being handled have been freshly printed in recto and verso. Accordingly, the quality of the printed sheets is maintained while still providing an efficient sheet brake. The present invention thus represents a substantial advance in the art.

BRIEF DESCRIPTION OF THE DRAWINGS

While the novel features of the controllable speed sheet brake and delivery assembly of the present invention are set forth with particularity in the appended claims, a full and complete understanding of the present invention may be had by referring to the description of preferred embodiments, as is set forth hereinafter, and as is illustrated in the accompanying drawings in which:

DESCRIPTION OF THE PREFERRED EMBODIMENT

Figure 1:
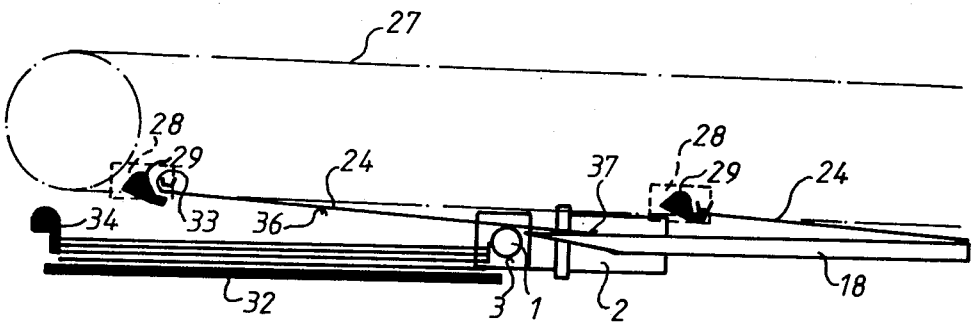
FIG. 1 is a schematic side elevation view of a sheet delivery assembly in accordance with the present invention.

Referring initially to FIG. 1, there may be seen an overall, somewhat schematic view of a preferred embodiment of a sheet delivery assembly and included a controllable speed sheet brake 1 in accordance with the present invention. A plurality of printed sheets 24, which may be recto and verso printed sheets, are each transported to a stacker table 32. Leading edges 33 of the sheets 24 are supported between spaced gripper chains 27 by means of generally known gripper carriages 28 that are provided with controllable gripper rows 29. Front or leading edges 33 of sheets 24 are held above a sheet guide plate 18 and pass over a controllable speed sheet brake roller 1. The trailing or back edges 37 of the sheets 24 are supported by a sheet guide plate 18. As each gripper carriage assembly 28 arrives at a selected location, an adjustable control means (not shown) which may be a gripper control cam or the like, opens each set of controllable gripper rows 29 and releases the leading edge 33 of each sheet 24. The sheet 24 thus becomes free and moves forwardly while its leading edge 33 is also moving down and into engagement with a stop 34 placed at the forward end of the stacker table 32.

Until sheet 24 is released from the gripper row 29, its forward or transport speed has been that of the gripper chains Vk. Concurrently, the controllable sheet brake roller has been driven by a controllable drive motor 2, in a manner to be discussed in greater detail subsequently, at a peripheral speed Vs which is generally the same as sheet transport speed Vk. Upon the release of the sheet 24 from the controllable gripper row 29, the braking roller's speed Vs is reduced or decelerated in a continuous manner until it reaches a sheet delivery speed Va, which is the desired speed of delivery of sheet 24 to stacker table 32. Typically this sheet delivery speed Va may be about 10% of the maximum gripper chain 27 transport speed Vk max. Since the controllable speed sheet braking roller 1 is provided with means to attract and hold the released sheets 24, their speed is reduced from the chain transport speed Vk to the desired sheet delivery speed Va as the sheet brake roller 1 slows down to sheet delivery speed Va.

Although the initial peripheral speed Vs of the controllable sheet brake roller 1 is coordinated to the sheet transport speed Vk imparted to the sheets 24 by the gripper chains 27, it is inevitable that some slippage will occur as the sheets contact the periphery of the roller 1 and are slowed during deceleration of the roller 1. Particularly where the undersurface 36 of sheet 24 has been printed, such as in recto and verso printing presses, there has, in prior art devices been a high frequency of smearing and smudging of the fresh ink, particularly that on the undersurface 36 of sheets 24. In accordance with the present invention, the controllable rotatable sheet brake roller 1 has a hydrophillic or ink repellent peripheral surface 3 and cooperates with a dampening unit 6, as will be discussed in greater detail shortly, to insure that ink from the surfaces 36 of sheets 24 does not adhere to roller 1. In this way smearing and smudging of the freshly printed sheets does not occur.

Figure 2:
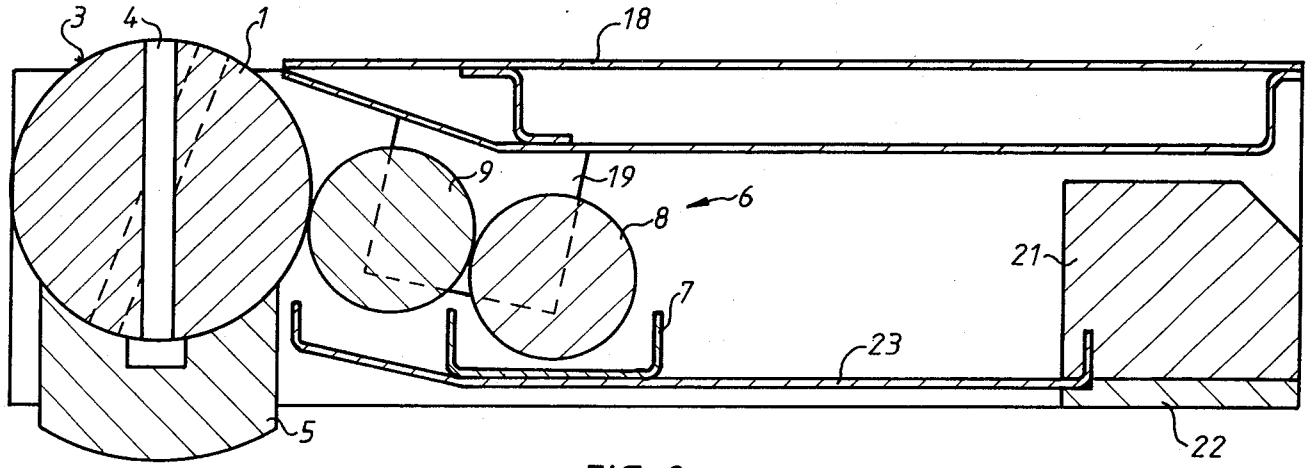
FIG. 2 is a side elevation view, partly in section, of a controllable speed sheet brake roller in accordance with the present invention and showing a first dampening unit associated with the roller.

Turning now to FIG. 2, it will be seen that sheet brake roller 1 is an elongated, shoulderless roller which may be provided with a plurality of diametrically extending suction holes 4. These holes 4 are arranged along the axial length of sheet brake roller 1 from the middle of roller 1 in a right hand or left hand screw thread line. Thus at any rotational position of sheet brake roller 1 some of these suction holes 4 are in contact with a cooperatively positioned suction bar 5 that can be connected to a suitable source of negative pressure such as a vacuum pump (not shown). Thus the periphery 3 of sheet brakes roller 1 is continuously able to exert an attracting force against the undersurface 36 of a sheet of paper 24. It will be understood that suction bar 5 is sealed with respect to roller 1 and to the machine side frames (not shown) which support it and roller 1. It will be further understood that roller 1 could be provided with an alternate sheet attracting means such as, for example by being an electrostatically charged roller.

Again referring to FIG. 2, in a first embodiment of the sheet brake and delivery assembly of the present invention, a dampening unit, generally at 6, cooperates with the rotatable controllable sheet brake roller 1. Dampening fluid is carried in a dampening tank 7 and is transferred to a chrome-covered or other hydrophillic surfaced doctor roller 8 and thence to a rubber-covered inking roller 9 which bears against the periphery 3 of sheet brake roller 1. Although not specifically shown, it will be understood that doctor roller 8 and inking roller 9 are driven through suitable gears or the like by sheet brake roller 1 such that a relative speed relationship between the sheet brake roller 1 and the inking roller 9, or between the inking roller 9 and the doctor roller 8 is produced whereby preferably the peripheral speed of the inking roller 9 is less than the peripheral speed of the sheet brake roller 1.

A pair of spaced butt straps 19 are secured to the underside of the sheet guide plate 18, as may be seen in FIG. 2, and provide support means for the ends of doctor roller 9 and inking roller 9. Sheet guide plate 18 is pivotable about a suitable hinge means (not shown) so that its free end adjacent sheet brake roller 1 can be raised to provide access to dampening unit 6. A dirt tank 23 is place beneath the sheet guide plate 18 and, in the embodiment shown in FIG. 2, supports dampening tank 7. This dirt tank 23 is secured to a pair of transverse partition members 21 and 22 which extend between the printing machine's side frames.

Figure 3:
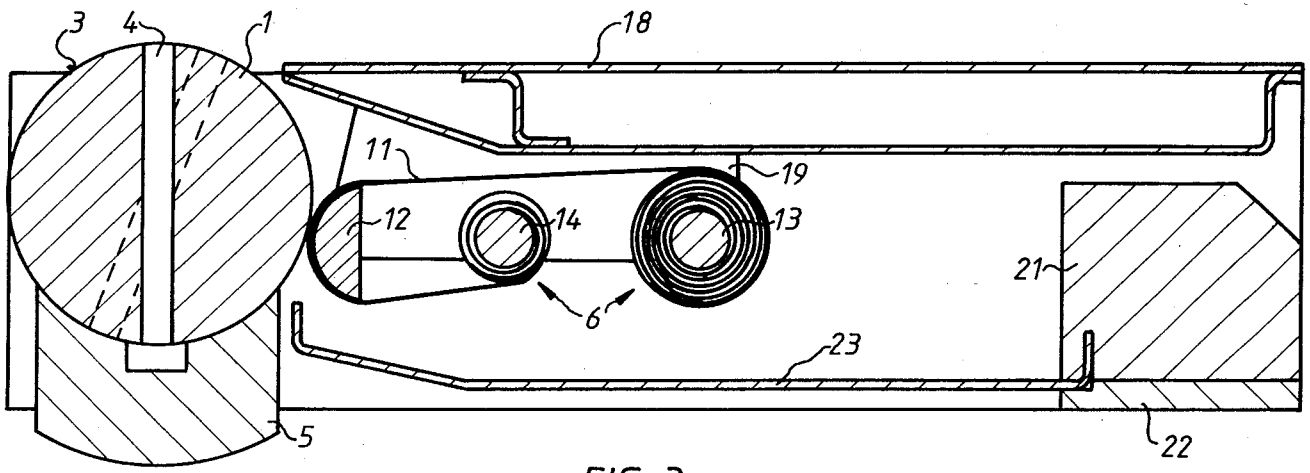
FIG. 3 is a view similar to FIG. 2 and showing a second dampening unit in association with the braking roller.

Turning now to FIG. 3, there may be seen a second preferred embodiment of a dampening unit 6 in use with controllable sheet brake roller 1. In this embodiment a dampened wiper tape 11 is pressed against the peripheral surface 3 of roller 1 by a pressing bar 12 which is supported between straps 19. Wiper tape 11 is initially wound on a supply spool 13 and is pulled gradually from this supply spool past the sheet brake roller 1 and in a direction opposite to the direction of rotation of roller 1 which, as seen in FIG. 3, is in a counterclockwise direction.

Figure 4:
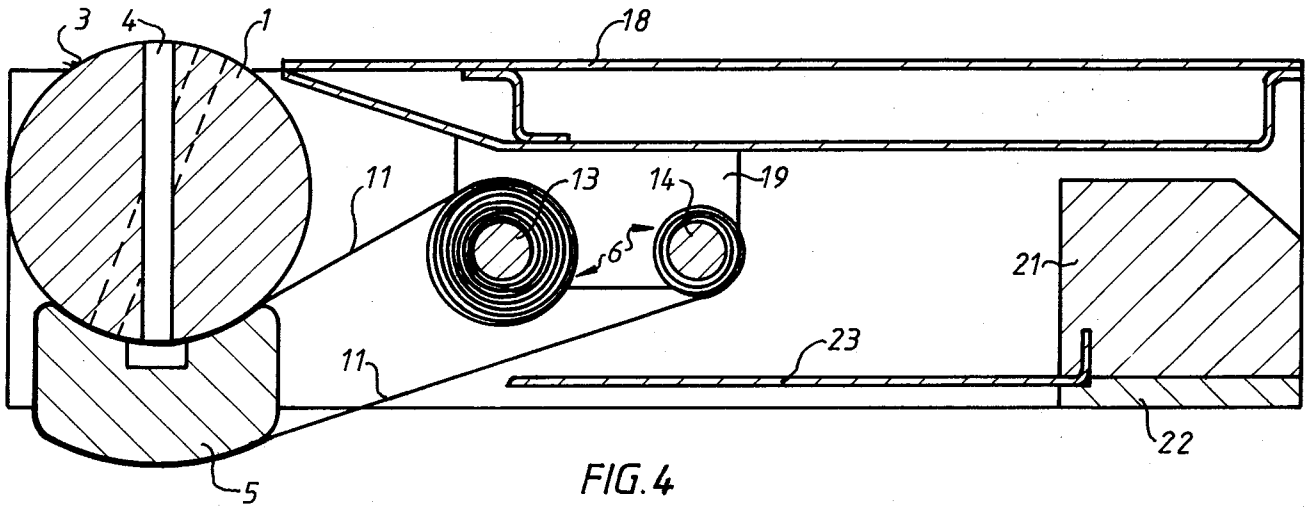
FIG. 4 is another view similar to FIG. 2 and showing a third preferred dampening unit.

A third preferred embodiment of a dampening unit may be seen in FIG. 4. In this configuration, which is generally similar to that shown in FIG. 3, the dampened wiper tape 11 is fed from supply reel 13 and between sheet brake roller 1 and suction bar 5. In this embodiment pressing bar 12 can be omitted since suction bar 5 also acts as a pressing bar.

Figure 5:
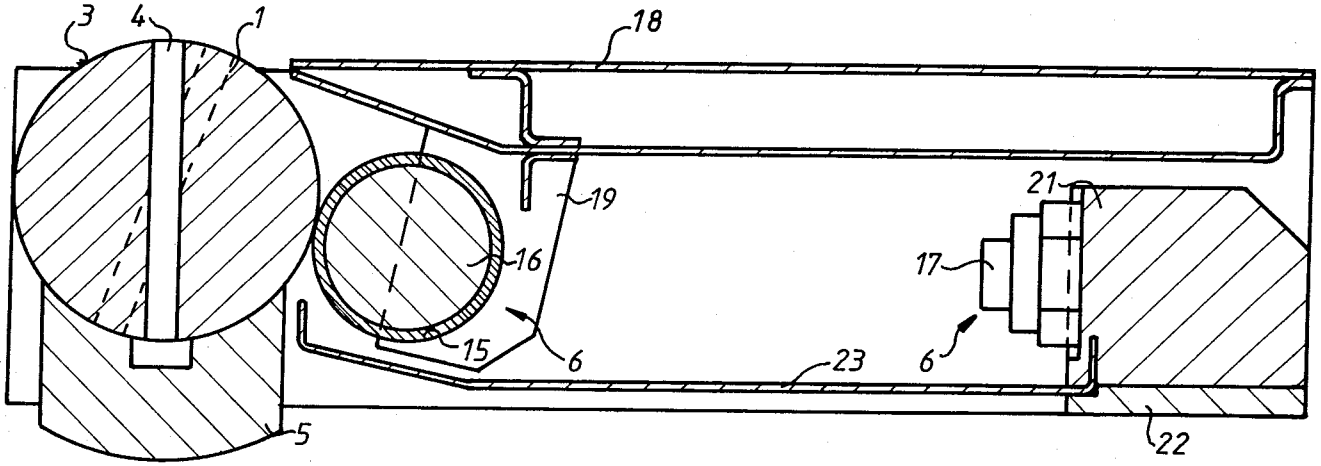
FIG. 5 is again a side elevation view, partly in section, of the controllable speed sheet brake roller of the present invention and showing a fourth dampening unit associated with the sheet brake roller.

A fourth preferred embodiment of a dampening unit 6 is shown in FIG. 5. In this unit a rotatable roller 16 is suspended between the spaced straps 19 and is provided with a covering 15 of a textile material such as MOLTEX. This covering is periodically dampened by spray nozzles 17 which may be supported by one of the transverse partitions 21.

Figure 6:
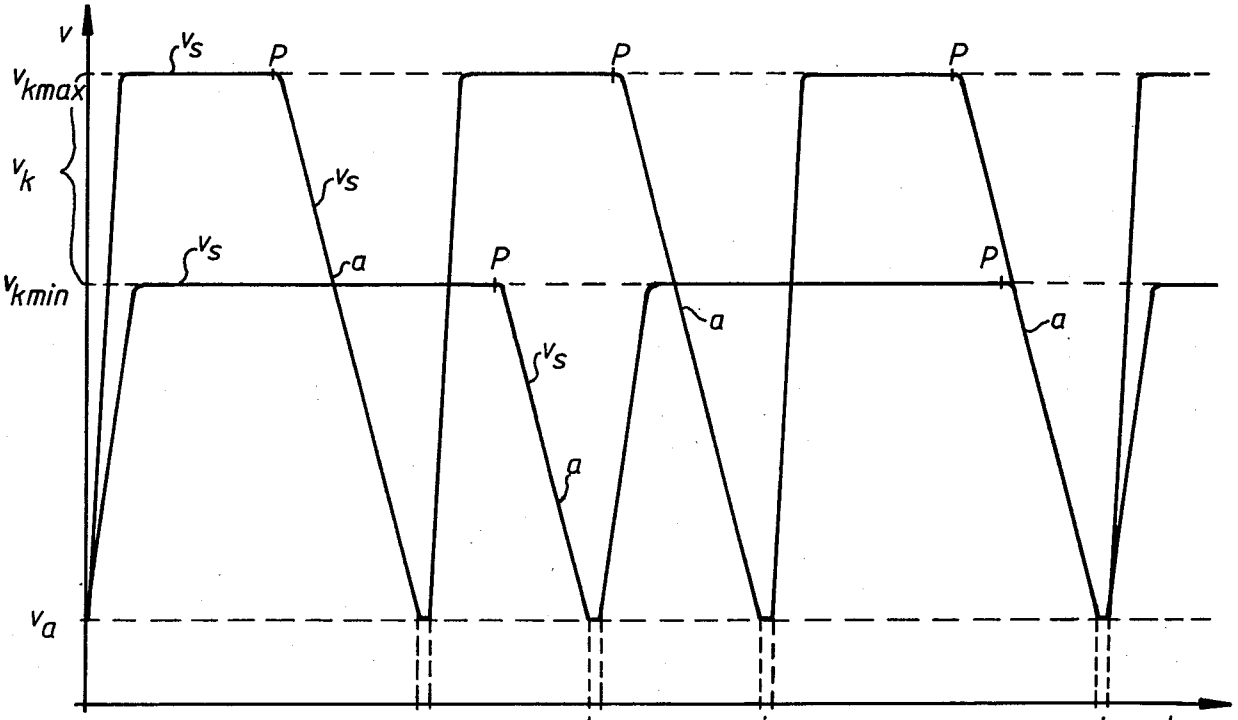
FIG. 6 is a time vs. speed diagram.

Referring now to FIG. 6 there may be seen a plot of sheet brake roller peripheral speed Vs as a function of time t. The sheet delivery speed Va is shown as a constant speed with respect to time by a generally horizontal dashed line. Additionally, a range of speeds for the gripper chains 27 and hence for the sheet transport speed is shown at Vk as being the distance between the minimum sheet transport speed Vk min and the maximum sheet transport speed Vk max. The point in time at which the sheet gripper 29 releases the leading edge 33 of each sheet 24 is indicated at point P on the sheet brake roller speed line Vs. A line of inclination, as indicated at a, shows the constant deceleration of the sheet brake roller from its original peripheral speed Vs that is the same as the sheet transport speed Vk, to a slower speed which is the same as the sheet delivery speed Va. This inclination a or deceleration of sheet brake roller 1 is independent of the original gripper chain speed Vk. A sheet delivery time ta is constant for all machine speeds and it is during this time that the roller peripheral speed Vs and the sheet delivery speed Va are the same.

By using an adjustable gripper control cam, it is possible to vary the release point of the grippers 29 in accordance with sheet transport speeds Vk. This allows the sheet brake roller 1 to provide a constant rate of deceleration regardless of initial sheet transport speed. Since the time at which the gripper 29 opens depends on the variable sheet transport speed Vk of the gripper chains 27 which corresponds to the production speed, as the production speed is increased, the sheet transport speed Vk is increased and the release point P is correspondingly shifted. This may be seen by the two solid line plots of sheet brake roller speed Vs shown in FIG. 6. As the sheet transport speed Vk increases, the length of time that the sheet brake roller runs at its higher speed Vs decreases, as shown by a shifting of point P to the left. Since the deceleration slope a remains the same and further since the delivery time ta also is a constant with varying production speeds, it will be seen that the rate of acceleration of the sheet brake roller from Va to Vs increases with increased production speeds Vk. As release time P is shifted with increased production speed, a longer sheet deceleration time a is provided.

Once the trailing edge 37 of each sheet 24 has left the surface 3 of sheet brake roller 1, as may be determined by appropriate sensing means, the sheet brake roller 1 must be accelerated by motor 2 back up to a peripheral speed Vs which is equal to the sheet transport speed Vk of the gripper chains 27. This is to insure that roller 1 has again attained its correct speed Vs before it receives the leading edge 33 of the next sheet 24. As discussed above, this increased acceleration can be seen in the steeper upward slope of the line Vs with regard to the plot for Vk max as compared to Vk min.

Since the peripheral surface 3 of sheet brake roller 1 has a hydrophillic or ink repelling surface, and further due to the provision of cooperating dampening units 6, any fresh ink particles that may be imparted to peripheral surface 3 of roller 1, especially during recto and verso printing, are quickly removed. This removal of ink particles by dampening unit 6 insures that no particles will be carried to the undersurface 36 of a successive sheet 24 so that the sheet 24 will not experience any smearing.

Sheet brake roller 1 is provided with a suitable drive motor 2 which may be a d.c. motor. A suitable control system is utilized to set and regulate the speed of the d.c. motor so that the sheet brake roller has a peripheral speed Vs generally the same as the speed Vk of the gripper chain until such time as the gripper sets 29 are opened. When that occurs, and the leading edge 33 of the sheet 24 is released, the motor 2 is slowed in a controlled manner to provide the sheet deceleration plot as shown at a in FIG. 6. This control may be accomplished by providing a d.c. tachometer generator for the main drive of the sheet-fed rotary printing machine. This tachometer generator produces a value and is designated a nominal valve emitter. A similar tachometer generator is coupled to d.c. motor 2 and produces a value and is designated as a real value emitter. Additionally, various electronic nominal value producers are provided in the control means.

As the printed sheet 24 is being transported by the gripper chains 27, the control system maintains the peripheral speed Vs of the roller 1 the same as that of the gripper chains speed Vk. This is done by using either a thyristor set or a transistor d.c. control to supply the appropriate amount of power to the d.c. motor so that the real value emitted by the motor and the nominal value emitted by the printing machine are equivalent. As soon as the grippers 29 open, the rpm nominal value control for the d.c. motor is switched from the nominal value produced by the tachometer generator coupled to the printing press to a nominal value emitted by the nominal value product of the control assembly. By selecting an appropriate imprinted nominal value of the nominal value producer, the d.c. motor can be decelerated so that roller 1 peripheral speed Vs is continually reduced until it has reached the desired delivery speed Va. In order to pre-set a desired delivery speed Va, the control assembly has a nominal valve input control element for the d.c. motor 2. While the drive motor 2 has been described as a d.c. motor, it could also be an a.c. motor. If this were the case, a static converter could be used to regulate the speed of the motor. The overall control means allows a desire sheet delivery speed Va to be selected and further regulates the drive motor 2 of the sheet brake roller 1 in such a manner that the roller will have a set delivery time ta, will accelerate to a sheet transport speed Vk, will maintain that speed until sheet release point P and will then constantly decelerate at rate a to the sheet delivery speed Va.

While a sheet brake and delivery assembly in accordance with the present invention has been fully and completely set forth hereinabove, it will be obvious to one of skill in the art that a number of changes in, for example the structure of the gripper chains, gripper carriages and controllable gripper rows, the type of rotary printing couples and the like could be made without departing from the true spirit and scope of the present invention and that the invention should be limited only by the following claims.

What is claimed is:

1. A sheet brake and delivery assembly for receiving a printed sheet from a sheet fed rotary printing press and for delivering the sheet to a sheet receiving means while reducing the speed of the sheet from a higher sheet transport speed to a lower sheet delivery speed, said assembly comprising:

a controllable sheet brake roller, said sheet brake roller being rotatable at the higher sheet transport speed during receipt of the printed sheet from the sheet fed rotary printing press and decelerating to rotate at the lower sheet delivery speed during delivery of the printed sheet to the sheet receiving means, said sheet brake roller having a non-shouldered cylindrical body with a peripheral surface which is printing ink repellent;

a dampening unit cooperating with said peripheral surface of said sheet brake roller; and means to retain the printed sheet on said peripheral surface of said sheet brake roller during deceleration of the printed sheet.

2. The sheet brake and delivery assembly of claim 1 wherein said means to retain the printed sheet on said peripheral surface of said sheet brake roller includes a plurality of suction holes passing though said sheet brake roller and means to apply a vacuum to said suction holes.

3. The sheet brake and delivery assembly of claim 1 wherein said sheet delivery speed is adjustable independently of said sheet transport speed.

4. The sheet brake and delivery assembly of claim 1 wherein said dampening unit includes a dampening tank for receiving a supply of dampening fluid, a rotatable doctor roller in contact with said dampening fluid, and a rotatable inking roller in contact with said doctor roller and said sheet brake roller to supply dampening fluid to said sheet brake roller.

5. The sheet brake and delivery assembly of claim 1 wherein said dampening unit includes a dampening wiper tape which is stored on a storage spool and which is drawn onto a rewinding spool, said wiper tape being pressed against said peripheral surface of said sheet brake roller by a pressing bar.

6. The sheet brake and delivery assembly of claim 1 wherein said dampening unit includes a textile covered roller which contacts said peripheral surface of said sheet brake roller, said textile covered roller receiving dampening fluid from at least one spray nozzle.

* * * * *